US012325953B2

(12) United States Patent
Kueker et al.

(10) Patent No.: US 12,325,953 B2
(45) Date of Patent: Jun. 10, 2025

(54) COMPOSITE COMPONENT CONTAINING A POLYCHLOROPRENE AND/OR POLYURETHANE BINDER

(71) Applicant: Covestro Deutschland AG, Leverkusen (DE)

(72) Inventors: Peter Kueker, Leverkusen (DE); Martin Melchiors, Leichlingen (DE); Michael Janz, Hüllhorst (DE); Anton Naue, Schladming (AT)

(73) Assignee: Covestro Deutschland AG, Leverkusen (DE)

( * ) Notice: Subject to any disclaimer, the term of this patent is extended or adjusted under 35 U.S.C. 154(b) by 575 days.

(21) Appl. No.: 17/289,787

(22) PCT Filed: Oct. 28, 2019

(86) PCT No.: PCT/EP2019/079386
§ 371 (c)(1),
(2) Date: Apr. 29, 2021

(87) PCT Pub. No.: WO2020/089163
PCT Pub. Date: May 7, 2020

(65) Prior Publication Data

US 2021/0395945 A1 Dec. 23, 2021

(30) Foreign Application Priority Data

Oct. 31, 2018 (EP) ..... 18203867

(51) Int. Cl.
*D06N 3/04* (2006.01)
*D04H 1/587* (2012.01)
(Continued)

(52) U.S. Cl.
CPC ..... *D06N 3/04* (2013.01); *D04H 1/587* (2013.01); *D04H 1/64* (2013.01); *D06N 3/0088* (2013.01); *D06N 3/14* (2013.01); *D06N 3/144* (2013.01)

(58) Field of Classification Search
None
See application file for complete search history.

(56) References Cited

U.S. PATENT DOCUMENTS 4,366,192 A 12/1982 McCartney
5,773,544 A * 6/1998 Christell ..... C09J 111/02 526/223

(Continued)

FOREIGN PATENT DOCUMENTS

CA 1155581 A 10/1983
DE 2446440 A1 4/1976

(Continued)

OTHER PUBLICATIONS

Janz—EP 2933136 A1—PCT D3—MT—cushion material—2015 (Year: 2015).*

(Continued)

*Primary Examiner* — John Vincent Lawler
(74) *Attorney, Agent, or Firm* — Richard P. Bender

(57) ABSTRACT

The invention relates to a method for producing a composite component, comprising the steps: i) applying an aqueous composition, which contains a polychloroprene dispersion and/or a polyurethane dispersion, to at least one nonwoven; ii) coagulating the aqueous composition on the nonwoven by bringing the aqueous composition into contact with a coagulant and/or heating to 80 to 220° C., in order to form a semifinished product; and iii) optionally attaching a decoration, which comprises an adhesive film; and iv) thereafter, shaping the semifinished product from step ii) or iii) by pressing and/or heating to 30 to 220° C., in order to obtain (Continued)

Figure 1:
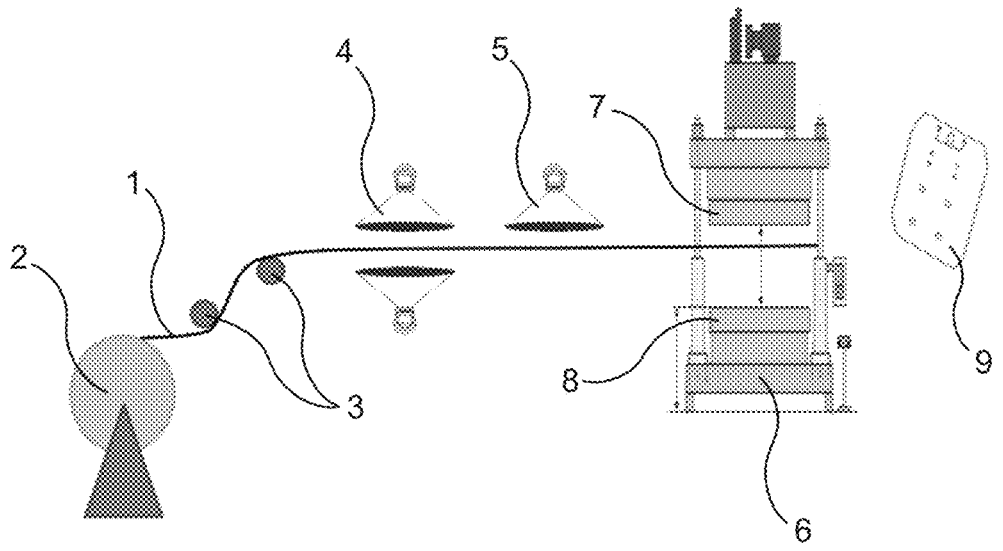

the composite component, characterized in that the aqueous composition contains at least one thickener. The invention further relates to the use of the composite component of the invention as part of an interior trim, of a sun visor, of a support part, of a 2- or 3-dimensional sound-proofing panel, of a 3D-printed component, of a padding material, of a collision protection means, of a seat shell and of an impact isolation means.

13 Claims, 2 Drawing Sheets

(51) Int. Cl.

| | |
|---|---|
| ***D04H 1/64*** | (2012.01) |
| ***D06N 3/00*** | (2006.01) |
| ***D06N 3/14*** | (2006.01) |

(56) References Cited

U.S. PATENT DOCUMENTS

| | | | | |
|---|---|---|---|---|
| 2002/0120045 | A1* | 8/2002 | Musch | C08F 36/18 524/285 |
| 2009/0053949 | A1* | 2/2009 | Achten | C08K 3/36 428/441 |
| 2010/0044909 | A1* | 2/2010 | Haskett | D04H 1/50 264/258 |
| 2016/0244898 | A1* | 8/2016 | Kalbe | D04H 1/645 |

FOREIGN PATENT DOCUMENTS

| | | | | |
|---|---|---|---|---|
| DE | 3002734 | A1 | 7/1981 | |
| DE | 3325163 | A1 | 1/1984 | |
| EP | 0916647 | A2 | 5/1999 | |
| EP | 2933136 | A1 * | 10/2015 | B60N 2/7017 |
| GB | 2124239 | A * | 2/1984 | C08L 11/02 |
| JP | 04-281074 | A | 10/1992 | |
| WO | 02/24825 | A1 | 3/2002 | |
| WO | 2005/035683 | A1 | 4/2005 | |
| WO | 2009/027013 | A1 | 3/2009 | |

OTHER PUBLICATIONS

International Preliminary Report on Patentability received for PCT Patent Application No. PCT/EP2019/079386, mailed on May 14, 2021, 16 pages (9 pages of English Translation and 7 pages of Original Document).

International Search Report and Written Opinion received for PCT Patent Application No. PCT/EP2019/079386, mailed on Dec. 16, 2019, 20 pages (8 pages of English Translation and 12 pages of Original Document).

* cited by examiner

COMPOSITE COMPONENT CONTAINING A POLYCHLOROPRENE AND/OR POLYURETHANE BINDER

CROSS-REFERENCE TO RELATED APPLICATIONS

This application is a national stage application (under 35 U.S.C. § 371) of PCT/EP2019/079386, filed Oct. 28, 2019, which claims benefit of European Application No. 18203867.9, filed Oct. 31, 2018, both of which are incorporated herein by reference in their entirety.

The invention relates to a process for producing a composite component, comprising the steps of:

i) applying an aqueous composition comprising a polychloroprene dispersion and/or polyurethane dispersion to at least one nonwoven web;

ii) coagulating the aqueous composition on the nonwoven web by contacting with a coagulant and/or heating to 80 to 220° C. in order to form a semifinished product comprising a binder formed from the aqueous composition;

iii) optionally applying a decoration including an adhesive film;

iv) then shaping the semifinished product from step ii) or iii) by pressing and/or heating to 30 to 220° C., in order to obtain the composite component;

v) optionally applying a layer, preferably of a thermoplastic polymer or resin, to a portion or the whole surface of the composite component and then optionally applying a decoration, characterized in that the aqueous composition comprises at least one thickener. The invention further relates to a composite component which is obtainable by the process of the invention and to an article comprising or consisting of said composite component. The invention further relates to the use of the composite component of the present invention as a constituent of an interior trim part, a sunvisor, a load-bearing part, a 2- or 3-dimensional soundproofing panel, a 3-dimensional printed component, a cushioning material, a collision protection barrier, a seat bucket and an impact insulation, and to the use of an aqueous composition of the invention as binder for composite components.

Lightweight composite components, especially as a constituent of a cushioning element, are known, for example, from EP 2 933 136 A1. Such composite components consist inter alia of a nonwoven web and a binder. More particularly, standard composite components frequently comprise a thermoset binder. A three-dimensionally stochastic fiber composite material bound with thermoset binder does not have point elasticity. Moreover, in this process, the fiber material is greatly limited and is formed from polyethylene terephthalate. The arrangement of the material with respect to the surface region always requires a nonwoven web and, in order to create comfort, for example in seat buckets, an additional comfort insert. The requirement for good shaping is not met by this specific composite material because its drapability is not good.

It is thus an object of the present invention to provide lightweight composite components that can be converted to their final shape by short pressing times, preferably below 10 seconds, and that can do without an additional comfort insert. It is also desirable for the composite components to have lower emissions of volatile organic compounds (VOCs).

The object was achieved by a process for producing a composite component, comprising the steps of:

i) applying an aqueous composition comprising a polychloroprene dispersion and/or polyurethane dispersion to at least one nonwoven web;

ii) coagulating the aqueous composition on the nonwoven web by contacting with a coagulant and/or heating to 80 to 220° C. in order to form a semifinished product comprising a binder formed from the aqueous composition;

iii) optionally applying a decoration including an adhesive film;

iv) then shaping the semifinished product from step ii) or iii) by pressing and/or heating to 30 to 220° C., in order to obtain the composite component;

v) optionally applying a layer, preferably of a thermoplastic polymer or resin, to a portion or the whole surface of the composite component and then optionally applying a decoration, characterized in that the aqueous composition comprises at least one thickener.

The inventors of the present invention have found that, surprisingly, the composite components thus obtained not only solve the aforementioned problems but can additionally be efficiently bonded and remain vacuum-compatible, meaning that further lamination is readily possible. It has also been surprisingly found that the specific binder of the present invention enables the later forming by means of high pressure and/or supply of heat. Moreover, further welding or riveting operations and also injection operations are possible.

In a first aspect, the invention relates to a process for producing a composite component, comprising the steps of:

i) applying an aqueous composition comprising a polychloroprene dispersion and/or polyurethane dispersion to at least one nonwoven web;

ii) coagulating the aqueous composition on the nonwoven web by contacting with a coagulant and/or heating to 80 to 220° C. in order to form a semifinished product comprising a binder formed from the aqueous composition;

iii) optionally applying a decoration including an adhesive film;

iv) then shaping the semifinished product from step ii) or iii) by pressing and/or heating to 30 to 200° C., in order to obtain the composite component;

v) optionally applying a layer, preferably of a thermoplastic polymer or resin, to a portion or the whole surface of the composite component and then optionally applying a decoration, characterized in that the aqueous composition comprises at least one thickener.

In a second aspect, the invention relates to a composite component obtainable by the process of the invention.

In a third aspect, the invention relates to an article comprising the composite component or consisting of the composite component of the present invention.

The invention additionally relates, in a fourth aspect, to the use of the composite component according to the present invention as a constituent of an interior trim part, a sunvisor, a load-bearing part, a 2- or 3-dimensional soundproofing panel, a 3-dimensional printed component, a cushioning material, a collision protection barrier, a seat bucket and an impact insulation.

The invention finally relates to the use of an aqueous composition comprising a polychloroprene dispersion and/or a polyurethane dispersion as defined in the present invention as binder for composite components.

"At least one", as used herein, refers to 1 or more, for example 2, 3, 4, 5, 6, 7, 8, 9 or more. In association with the invention described herein, this indication relates not to the absolute amount or number of a molecule or constituent but to the nature of the constituent. What is meant by "at least one additive" is therefore, for example, that at least one type of additives is present, but it is also possible for two or more different types of additives to be present. "At least one" does not relate here to the amount of additive molecules present in the composition.

Numerical values specified herein without decimal places each refer to the full value specified with one decimal place. For example, "99%" signifies "99.0%".

The expressions "roughly" or "about", in connection with a numerical value, refer to a variance of ±10%, based on the numerical value specified, preferably ±5%, more preferably ±1%.

All percentages, unless explicitly stated otherwise, are % by weight (% by wt.).

The aspects, embodiments, features and advantages of the invention described above, and those which follow, will be apparent to the person skilled in the art from studying the detailed description and claims that follow. It is possible here to use any feature from one embodiment of the invention in any other embodiment of the invention. It will also be appreciated that the examples included herein are intended to describe and illustrate the invention, but not to restrict it, and the invention is especially not limited to these examples.

The invention relates more particularly to:

1. A process for producing a composite component, comprising the steps or consisting of the steps of:
   i) applying an aqueous composition comprising a polychloroprene dispersion and/or a polyurethane dispersion to at least one nonwoven web, preferably by spraying, dipping or injecting;
   ii) coagulating the aqueous composition on the nonwoven web by contacting with a coagulant and/or heating to 80 to 220° C., preferably 180 to 220° C., in order to form a semifinished product comprising a binder formed from the aqueous composition;
   iii) optionally applying a decoration including an adhesive film;
   iv) then shaping the semifinished product from step ii) or iii) by pressing, preferably for 0.1 to 30 seconds, more preferably 1 to 15 seconds, especially preferably for 3 to 10 seconds, and/or heating to 30 to 220° C., preferably 60 to 220° C., especially preferably to 180 to 220° C., in order to obtain the composite component;
   v) optionally applying a layer, preferably of a thermoplastic polymer or resin, more preferably the binder as in step ii), to a portion or the whole surface of the composite component and then optionally applying a decoration;
   vi) optionally, after step iv) or v), further shaping by again pressing and/or treating with heat;
   vii) optionally, after one of steps iv) to vi), cutting or punching the composite component, preferably in the mold, especially in the pinch edge mold, characterized in that the aqueous composition comprises at least one thickener.
2. The process according to embodiment 1, characterized in that the polychloroprene dispersion and/or the polyurethane dispersion has an average particle size of 60 to 300 nm.
3. The process according to any of the preceding embodiments, characterized in that the composition also comprises an aqueous silicon dioxide dispersion.
4. The process according to any of the preceding embodiments, characterized in that the aqueous composition comprises or consists of
   a) a polychloroprene dispersion and/or a polyurethane dispersion, preferably having an average particle size of 60 to 300 nm;
   b) at least one thickener, preferably selected from polyacrylic acids, water-soluble polyurethanes, silicas, cellulose derivatives such as polycarboxylated cellulose ethers, nonionic cellulose ethers and microfibrilated cellulose, alginates, xanthans, polyvinyl alcohols and mixtures thereof;
   c) optionally an aqueous silicon dioxide dispersion, preferably having an average particle diameter of the silicon dioxide particles of 1 to 400 nm; and
   d) optionally further additives.
5. The process according to embodiment 3 or 4, characterized in that the amount of c) is 10% to 90% by weight, preferably 25% to 85% by weight, more preferably 40% to 75% by weight, based on the total weight of the nonvolatile components of the aqueous composition.
6. The process according to embodiment 4 or 5, characterized in that the aqueous composition comprises or consists of
   9.9% to 90% by weight, preferably 14.7% to 75% by weight, of a);
   0.01% to 15% by weight, preferably 0.3% to 5% by weight, of b);
   9.9% to 90% by weight, preferably 24.7 to 85% by weight, more preferably 40 to 75% by weight, of c);
   0% to 50% by weight, preferably 0.1% to 25% by weight, more preferably 3% to 15% by weight, of d);
   based in each case on the total weight of the nonvolatile components of the aqueous composition.
7. The process according to any of the preceding embodiments, characterized in that the aqueous composition has a viscosity of 500 to 7000 mPa*s, determined to DIN ISO 2555 by means of a Brookfield rotary viscometer with spindle #2 up to a viscosity of 2500 mPa*s, and above that with a spindle #3, at 12 rpm and 23° C.
8. The process according to any of the preceding embodiments, characterized in that, after step ii), 20 to 600 $g/m^2$ dry weight, preferably 200 to 400 $g/m^2$ dry weight, further preferably 250 to 350 $g/m^2$ dry weight, of binder is present on a nonwoven web. If a decorative layer has also been applied by bonding, the amount of binder is typically increased by the amount of binder expended for the bonding to the decorative layer.
9. The process according to any of the preceding embodiments, characterized in that the at least one nonwoven web consists of polyolefin-, polyethylene terephthalate-, polyether sulfone-, glass-, mineral-, carbon- or plant-based fibers, such as cotton fibers, coconut fibers, rice cotton fibers, or mixtures thereof; and/or in that a nonwoven web has a density of 300 to 1200 $g/m^2$, preferably 400 to 550 $g/m^2$ or 900 to 1100 $g/m^2$.
10. The process according to any of the preceding embodiments, characterized in that at least two nonwoven webs are used, and the binder is between the nonwoven webs.

11. The process according to any of the preceding embodiments, characterized in that a coagulant is used, preferably a salt solution, more preferably a $CaCl_2$ solution.
12. The process according to any of the preceding embodiments, characterized in that the adhesive film consists of a binder that is obtained from an aqueous composition, as defined in step (i), which coagulates as in step (ii), wherein the binder is preferably not completely dried, in order to obtain a moist adhesive film.
13. The process according to any of the preceding embodiments, characterized in that the decoration, for example a textile fabric with foam backing, leather or a film, in step iii), is likewise wetted with binder on one side, on the foam side in the case of a textile fabric with foam backing, but is not dried or not dried completely, so as to leave a moist adhesive film, and the binder-coated decoration is placed by the moist adhesive film side onto the binder-coated nonwoven web from step ii) or is run into a press by respective rolls and then pressed in step iv).
14. A composite component obtainable by a process according to any of embodiments 1 to 13, wherein the composite component especially has a basis weight of 900 to 2000 g/m$^2$, preferably of 1100 to 1400 g/m$^2$, more preferably of 1250 to 1350 g/m$^2$, most preferably 1300 g/m$^2$.
15. An article comprising or consisting of the composite component according to embodiment 14, wherein the article is preferably selected from an interior trim part, especially door trim, back panel, trunk trim, a sunvisor, a load-bearing part, especially seat foams, cushion materials, a 2- or 3-dimensional soundproofing panel, a 3-dimensional printed component, a cushioning material, especially in car seats, cushioned furniture, a collision protection barrier and an impact insulation.
16. The use of the composite component according to embodiment 14 as a constituent of an interior trim part, especially door trim, back panel, trunk trim, a sunvisor, a load-bearing part, especially seat foams, cushion materials, a 2- or 3-dimensional soundproofing panel, a 3-dimensional printed component, a cushioning material, especially in car seats, cushioned furniture, a collision protection barrier, a seat bucket or an impact insulation.
17. The use of an aqueous composition comprising a polychloroprene dispersion and/or a polyurethane dispersion as defined in any of embodiments 1 to 7 as binder for composite components, especially composite components comprising at least one nonwoven web.

According to the present invention, the composite component comprises a thermoplastic binder which is obtained by coagulating an aqueous composition comprising a polychloroprene dispersion and/or a polyurethane dispersion, also referred to hereinafter merely as aqueous composition.

The coagulating is effected either with the aid of a coagulant or by heating, or both. Suitable coagulants are known to the person skilled in the art in the field of polychloroprene dispersions and/or polyurethane dispersions. They are preferably salt solutions, especially aqueous salt solutions, especially preferably containing $CaCl_2$. Most preferred is a 2% to 5% by weight aqueous salt solution, especially $CaCl_2$ solution. The application of the coagulant preferably takes place by means of spraying, dipping or injection. Likewise possible are painting, casting, knife coating and rolling.

If the coagulating is performed by means of heating, preference is given here to temperatures of 80 to 220° C.

In a preferred embodiment, there is both use of a coagulant and subsequent heating.

In a first step, the aqueous composition is applied to at least one nonwoven web. For this purpose, it is possible to use techniques that are customary in the specialist field. Suitable examples include application by spraying the nonwoven web with the aqueous composition; injecting the aqueous composition; or dipping the nonwoven web into the aqueous composition. Likewise possible are painting, casting, knife coating and rolling. However, preference is given to spraying, injecting and dipping. The application can preferably be effected at temperatures of −5° C. up to 80° C., preferably at 5° C. to 45° C., more preferably 10° C. to 35° C., most preferably 20 to 30° C. The composition may additionally be blown into the nonwoven web by means of compressed air after application to the nonwoven web.

Particularly suitable aqueous compositions containing a polychloroprene dispersion and/or a polyurethane dispersion are described below.

Polychloroprene Dispersion (a1)

Polychloroprene dispersions that are suitable in accordance with the invention are prepared by emulsion polymerization of chloroprene and optionally an ethylenically unsaturated monomer copolymerizable with chloroprene in an alkaline medium, as disclosed, for example, in WO-A 02/24825 (page 3 line 26-page 7 line 4), DE-A 30 02 734 (page 8 line 23-page 12 line 9), U.S. Pat. No. 5,773,544 (column 2 line 9 to column 4 line 45) or WO 2009/027013 A. Particular preference is given to polychloroprene dispersions that are prepared by continuous polymerization, as described, for example, in WO 02/24825 A, example 2, and DE 3 002 734, example 6, wherein the chain transfer agent content can be varied between 0.01% and 0.3%.

In a preferred embodiment, the at least one polychloroprene present in the polychloroprene dispersion a) has a Shore A value of 10 to 100, preferably of 30 to 95, more preferably of 60 to 90. It is also possible to use mixtures of 2 or more different polychloroprenes; in an alternative embodiment, all the polychloroprenes present in the polychloroprene dispersion a) have a Shore A value of 10 to 100, preferably of 15 to 95.

In a preferred embodiment, the polychloroprene is an anionic polychloroprene. In a particularly preferred embodiment, it has a pH of 8 to 14, more preferably of 9 to 13, most preferably of 10 to 13, measured to DIN ISO 976:2013. The determination can be effected by means of a Metrohm 826 pH mobile pH meter; the combination electrode used may be the Metrohm LL Protrode WOC. Measurement accuracy can be increased by a 20-fold determination of a single sample and averaging of the results obtained.

If the pH is in the range from 10 to 13, elevated storage stability of the aqueous composition is attained. In addition, pH values below 8 can have the effect that the aqueous composition or adhesive sets too quickly, which can lead to quality problems in warmer months.

The proportion of the respective components is based on the total weight of the nonvolatile components of the aqueous composition; the sum total of the components of the aqueous composition a) to e) adds up to 100% by weight.

The Shore A value is determined as described in DIN ISO 7619-2010 by means of a Zwick 3114 durometer type A (hardness A-2.5 N).

Polyurethane Dispersion (a2)

Aqueous polyurethane dispersions that are used in adhesives for demanding industrial applications, for example in shoe manufacture, bonding of parts for motor vehicle interiors, film lamination or the bonding of textile substrates, are known.

The dispersions referred to as polyurethane dispersions in connection with the present invention contain, as disperse phase, polymers which may be polyurethanes in the narrower sense, that is to say those polymers which are obtained by polymerization of polyols and polyisocyanates, but they may also be those in which monoamines and/or diamines are also used as formation components, possibly as chain extenders. Polyurethane dispersions usable in accordance with the invention are thus both pure aqueous polyurethane dispersions and polyurethane-urea dispersions.

In the present invention, preference is given to using polyurethane dispersions that contain semicrystalline segments and can be processed by the thermal activation method. In the thermal activation method, the dispersion is applied to the substrate and, after complete evaporation of the water, the adhesive layer is activated by heating, for example using an infrared radiator, and is converted to an adhesive state. The temperature at which the adhesive film becomes sticky is referred to as the activation temperature. The aqueous polyurethane or polyurethane-urea dispersion used with preference contains, as disperse phase, a polymer A) that is semicrystalline or crystalline after drying.

A polymer is referred to as semicrystalline or crystalline when it exhibits a melting peak in DSC measurement in accordance with DIN 65467 with a heating rate of 20 K/min. The melting peak is caused by the melting of regular substructures in the polymer. The melting temperature of the polymers or polymer layers obtained from the formulations of the invention is preferably within a range from 35° C. to 80° C., more preferably from 40° C. to 70° C., most preferably from 42° C. to 55° C. The enthalpy of fusion of the polymer layers obtained from the formulations of the invention is ≥35 J/g, preferably ≥40 J/g, more preferably ≥45 J/g. The first heating is evaluated in order to also detect polymers which crystallize slowly.

Polymer A is more preferably formed from

A(i). at least one crystalline or semicrystalline difunctional polyester polyol having a number-average molecular weight of at least 400 g/mol and a melting temperature of at least 35° C. and a heat of fusion of at least 35 J/g, A(ii). optionally at least one difunctional polyol component having a number-average molecular weight of 62 to 399 g/mol, A(iii). an isocyanate component, A(iv). at least one isocyanate-reactive component bearing at least one ionic or potentially ionic group, other than A(i) and A(ii), and A(v). optionally further isocyanate-reactive components other than A(i), A(ii) and A(iv).

The aqueous dispersions of the invention preferably contain 15% to 60% by weight of polymer and 40% to 85% by weight of water, preferably 30% to 50% by weight of polymer and 50% to 70% by weight of water, more preferably 38% to 52% by weight of polymer and 48% to 62% by weight of water.

The polymer preferably contains 50% to 95% by weight of constituent A(i), 0% to 10% by weight of constituent A(ii), 4% to 25% by weight of constituent A(iii), 0.5% to 10% by weight of constituent A(iv) and 0% to 30% by weight of constituent A(v), where the sum total of the constituents adds up to 100% by weight.

In a preferred form of the invention, the polymer contains 65% to 92% by weight of constituent A(i), 0% to 5% by weight of constituent A(ii), 6% to 15% by weight of constituent A(iii), 0.5% to 5% by weight of constituent A(iv) and 0% to 25% by weight of constituent A(v), where the sum total of the constituents adds up to 100% by weight.

In a particularly preferred form of the invention, the polymer contains 75% to 92% by weight of constituent A(i), 0% to 5% by weight of constituent A(ii), 8% to 15% by weight of constituent A(iii), 0.5% to 4% by weight of constituent A(iv) and 0% to 15% by weight of constituent A(v), where the sum total of the constituents adds up to 100% by weight.

In a very particularly preferred form of the invention, the polymer contains 80% to 90% by weight of constituent A(i), 0% to 3% by weight of constituent A(ii), 8% to 14% by weight of constituent A(iii), 0.5% to 3% by weight of constituent A(iv) and 0% to 10% by weight of constituent A(v), where the sum total of the constituents adds up to 100% by weight.

Useful crystalline or semicrystalline difunctional polyester polyols A(i) are especially linear or else lightly branched polyester polyols based on dicarboxylic acids and/or derivatives thereof, such as anhydrides, esters or acid chlorides and preferably aliphatic linear polyols. Mixtures of dicarboxylic acids and/or derivatives thereof are also suitable. Suitable dicarboxylic acids are, for example, adipic acid, succinic acid, sebacic acid or dodecanedioic acid. Preference is given to succinic acid, adipic acid and sebacic acid and mixtures of these, particular preference is given to succinic acid and adipic acid and mixtures of these, and very particular preference is given to adipic acid. These are used in amounts of at least 90 mol %, preferably of from 95 to 100 mol %, based on the total amount of all carboxylic acids.

The difunctional polyester polyols A(i) can be prepared, for example, by polycondensation of dicarboxylic acids with polyols. The polyols preferably have a molar mass of 62 to 399 g/mol, consist of 2 to 12 carbon atoms, are preferably unbranched, difunctional and preferably have primary OH groups.

Examples of polyols, which may be used for the preparation of the polyester polyols A(i), are polyhydric alcohols, for example ethanediol, di-, tri-, or tetraethylene glycol, propane-1,2-diol, di-, tri-, or tetrapropylene glycol, propane-1,3-diol, butane-1,4-diol, butane-1,3-diol, butane-2,3-diol, pentane-1,5-diol, hexane-1,6-diol, 2,2-dimethylpropane-1,3-diol, 1,4-dihydroxycyclohexane, 1,4-dimethylolcyclohexane, octane-1,8-diol, decane-1,10-diol, dodecane-1,12-diol or mixtures of these.

Preferred polyol components for the polyester polyols A(i) are ethane-1,2-diol, butane-1,4-diol and hexane-1,6-diol; particular preference is given to butane-1,4-diol and hexane-1,6-diol, very particular preference is given to butane-1,4-diol.

The polyester polyols A(i) may be formed from one or more polyols. In a preferred embodiment of the present invention, they are formed from just one polyol.

If the crystalline or semicrystalline difunctional polyester polyols having a number-average molecular weight of at least 400 g/mol and a melting temperature of at least 35° C. have a heat of fusion of at least 50 J/g, the polymer prepared using these will regularly have a heat of fusion of 35 J/g. If desired, adjustment of the heat of fusion of the polymer can be achieved by a slight modification of the content of polyester polyol A(i) in the composition or by a small variation of the heat of fusion of the polyester polyol. These measures require only exploratory experiments and are completely within the practical experience of a person of average skill in the art in this field.

The preparation of polyester polyols A(i) is known from the prior art.

The number-average molecular weight of the polyester polyols A(i) is preferably between 400 and 4000 g/mol, more preferably between 1000 and 3000 g/mol, particularly preferably between 1500 and 2500 g/mol, and very particularly preferably between 1800 and 2400 g/mol. The number-average molecular weight is ascertained, for example, by means of GPC measurements using polystyrene standards.

The melting temperature of the crystalline or semicrystalline polyester polyols is generally at least 35° C., preferably between 40 and 80° C., more preferably between 42 and 60° C. and most preferably between 45 and 52° C. The heat of fusion is ≥35 J/g, preferably ≥40 J/g and more preferably ≥50 J/g.

Examples of difunctional polyol components having a molecular weight of 62 to 399 g/mol which are suitable as formation component A(ii) include the polyols mentioned for the preparation of the polyester polyols A(i). Low molecular weight polyester diols, polyether diols, polycarbonate diols or other polymer diols are in principle also suitable, provided they have a molecular weight of 62 to 399 g/mol.

Suitable formation components A(iii) are any desired organic compounds having at least two free isocyanate groups per molecule. Preference is given to using diisocyanates $Y(NCO)_2$, where Y is a divalent aliphatic hydrocarbon radical having 4 to 12 carbon atoms, a divalent cycloaliphatic hydrocarbon radical having 6 to 15 carbon atoms, a divalent aromatic hydrocarbon radical having 6 to 15 carbon atoms or a divalent araliphatic hydrocarbon radical having 7 to 15 carbon atoms. Examples of such diisocyanates that are preferably to be used include tetramethylene diisocyanate, methylpentamethylene diisocyanate, hexamethylene diisocyanate, dodecamethylene diisocyanate, 1,4-diisocyanatocyclohexane, 1-isocyanato-3,3,5-trimethyl-5-isocyanatomethylcyclohexane, 4,4'-diisocyanatodicyclohexylmethane, 4,4'-diisocyanato-2,2-dicyclohexylpropane, 1,4-diisocyanatobenzene, 2,4-diisocyanatotoluene, 2,6-diisocyanatotoluene, 4,4'-diisocyanatodiphenylmethane, 2,2'- and 2,4'-diisocyanatodiphenylmethane, tetramethylxylylene diisocyanate, p-xylylene diisocyanate, p-isopropylidene diisocyanate, and mixtures composed of these compounds.

It is also possible also to use proportions of higher-functionality polyisocyanates known per se in polyurethane chemistry, or else modified polyisocyanates known per se and for example comprising carbodiimide groups, allophanate groups, isocyanurate groups, urethane groups and/or biuret groups.

In addition to these simple diisocyanates, polyisocyanates containing heteroatoms in the radical linking the isocyanate groups and/or having a functionality of more than 2 isocyanate groups per molecule are also suitable. The former are, for example, polyisocyanates which have been prepared by modification of simple aliphatic, cycloaliphatic, araliphatic and/or aromatic diisocyanates, are formed from at least two diisocyanates, and have a uretdione, isocyanurate, urethane, allophanate, biuret, carbodiimide, iminooxadiazinedione and/or oxadiazinetrione structure. One example of an unmodified polyisocyanate having more than 2 isocyanate groups per molecule is, for example, 4-isocyanatomethyloctane 1,8-diisocyanate (nonane triisocyanate).

Particularly preferred formation components A(iii) are hexamethylene diisocyanate (HDI) and 1-isocyanato-3,3,5-trimethyl-5-isocyanatomethylcyclohexane (IPDI), and mixtures thereof.

Preferred isocyanate-reactive components A(iv) bearing at least one ionic or potentially ionic group are mono- and dihydroxycarboxylic acids, mono- and diaminocarboxylic acids, mono- and dihydroxysulfonic acids, mono- and diaminosulfonic acids and also mono- and dihydroxyphosphonic acids or mono- and diaminophosphonic acids and alkali metal and ammonium salts thereof. Examples are dimethylolpropionic acid, dimethylolbutyric acid, hydroxypivalic acid, N-(2-aminoethyl)-β-alanine, N-(2-aminoethyl)-2-aminoethanesulfonic acid, N-(2-aminoethyl)-2-aminoethanecarboxylic acid, ethylenediaminepropyl- or -butylsulfonic acid, propylene-1,2- or -1,3-diamine-β-ethylsulfonic acid, malic acid, citric acid, glycolic acid, lactic acid, glycine, alanine, taurine, lysine, 3,5-diaminobenzoic acid, an addition product of IPDI and acrylic acid (EP-A 0 916 647, Example 1) and the alkali metal and/or ammonium salts thereof; the adduct of sodium bisulfite onto but-2-ene-1,4-diol, polyethersulfonate, the propoxylated adduct of 2-butenediol and $NaHSO_3$, described, for example, in DE-A 2 446 440 (pages 5-9, formulae I-III). Of good suitability for salt formation are hydroxides of sodium, potassium, lithium and calcium and tertiary amines such as triethylamine, dimethylcyclohexylamine and ethyldiisopropylamine. Other amines can also be used for salt formation, such as ammonia, diethanolamine, triethanolamine, di methylethanolamine, methyldiethanolamine, aminomethylpropanol and also mixtures of the amines specified and also others. It is advisable to add these amines only after the isocyanate groups have been largely converted.

Further suitable as component A(iv) are units which by addition of acids can be converted into cationic groups, such as N-methyldiethanolamine.

Particularly preferred components A(iv) are those having carboxyl and/or carboxylate and/or sulfonate groups.

Very particular preference is given to the sodium salts of N-(2-aminoethyl)-2-aminoethanesulfonic acid and of N-(2-aminoethyl)-2-aminoethanecarboxylic acid, especially of N-(2-aminoethyl)-2-aminoethanesulfonic acid. Very particular preference is also given to the salts of dimethylolpropionic acid.

Isocyanate-reactive components A(v) may, for example, be polyoxyalkylene ethers containing at least one hydroxyl or amino group. The frequently used polyalkylene oxide polyether alcohols are obtainable in a manner known per se by alkoxylation of suitable starter molecules. Alkylene oxides suitable for the alkoxylation reaction are especially ethylene oxide and propylene oxide, which can be used individually or else together in the alkoxylation reaction.

Further examples of isocyanate-reactive components A(v) are monoamines, diamines and/or polyamines, and mixtures thereof.

Examples of monoamines are aliphatic and/or alicyclic primary and/or secondary monoamines such as ethylamine, diethylamine, the isomeric propyl- and butylamines, higher linear aliphatic monoamines and cycloaliphatic monoamines such as cyclohexylamine. Further examples are amino alcohols, i.e. compounds containing amino and hydroxyl groups in one molecule, for example ethanolamine, N-methylethanolamine, diethanolamine or 2-propanolamine. Examples of diamines are ethane-1,2-diamine, hexamethylene-1,6-diamine, 1-amino-3,3,5-trimethyl-5-aminomethylcyclohexane (isophoronediamine), piperazine, 1,4-diaminocyclohexane and bis(4-aminocyclohexyl)methane. Adipic dihydrazide, hydrazine and hydrazine hydrate are additionally suitable. Further examples are amino alcohols, i.e. compounds containing amino and hydroxyl groups in one molecule, for example 1,3-diamino-2-propanol, N-(2-hydroxyethyl)ethylenediamine or N,N-bis(2-hydroxyethyl)ethylenediamine. Examples of polyamines are diethylenetriamine and triethylenetetramine.

In a preferred form of the invention, the polymer of the invention contains, for adjusting the molar mass, at least one monoamine and/or at least one diamine as isocyanate-reactive component A(v).

Component (a) used in the context of the present invention may be a dispersion (a1) based on one or more polychloroprene polymers, a dispersion (a2) based on one or more polyurethane and/or polyurea polymers, or mixtures of (a1) and (a2).

Thickener b)

The aqueous composition for the use of the present invention comprises at least one thickener. Suitable thickeners are described, for example, in W. Heilen et al. "Additive für wässrige Lacksysteme" [Additives for Aqueous Paint Systems], Vincentz-Verlag Hanover, ISBN 978-3-86630-845-9, page 61 ff. Suitable thickeners are described, for example, in amounts of 0.01% to 15% by weight, based on the nonvolatile components of the aqueous composition, preferably selected from the group consisting of polyacrylic acids, water-soluble polyurethanes, silicas, cellulose derivatives such as polycarboxylated cellulose ethers, nonionic cellulose ethers and microfibrilated celluloses, alginates, xanthans, polyvinyl alcohols and mixtures thereof. In a further embodiment, the thickeners are present in amounts of 0.3% to 5.0% by weight, based on nonvolatile components of the aqueous composition.

The presence of at least one thickener in the aqueous composition achieves multiple technical advantages. For example, the stability of the aqueous composition is increased, especially when further constituents, for example flame retardants, such as $Al(OH)_3$, are additionally present. In addition, the addition of the at least one thickener increases the viscosity, hence improving the process. If aqueous compositions without thickener are used, this or the adhesive is sucked in too significantly by the vacuum applied, and the distribution of the aqueous composition or adhesive in the component is often inadequate. The presence of the thickener can likewise achieve more exact dosage and lower dripping of the aqueous composition.

Also achieved is a more constant layer thickness after application of the aqueous composition to the nonwoven web compared to compositions containing no thickeners.

Aqueous Silicon Dioxide Dispersion c)

The aqueous composition may further comprise an aqueous silicon dioxide dispersion. Aqueous dispersions of silicon dioxide have long been known. They have different structures according to the production process. Silicon dioxide dispersions that are suitable in accordance with the invention may be obtained on the basis of silica sol, silica gel, fumed silicas or precipitated silicas, or mixtures of these. Aqueous silicon dioxide dispersions wherein the $SiO_2$ particles have an average particle diameter of 1 to 400 nm, preferably 5 to 100 nm and more preferably 8 to 55 nm are used where appropriate. If precipitated silicas are used, these are ground for the purpose of particle size reduction. The average particle diameter is determined by laser diffraction in a laser diffractometer. First of all, a sample of the silica dispersion or of the aqueous composition is taken while stirring, transferred to a beaker and diluted by addition of water without addition of dispersing additives so as to give a dispersion having a proportion by weight of about 1% by weight of $SiO_2$. In order to determine the particle size of powders, a dispersion having a proportion by weight of about 1% by weight of $SiO_2$ is prepared by stirring the powder into water. Immediately after the dispersion, the particle size distribution of a sample portion of the dispersion is determined with the laser diffractometer. For the measurement, a relative refractive index of 1.09 should be chosen. All measurements are effected at room temperature.

Silica sols are colloidal solutions of amorphous silicon dioxide in water that are also referred to as silicon dioxide sols. The silicon dioxide here is in the form of spherical particles having surface hydroxylation. The particle diameter of the colloid particles is generally 1 to 200 nm, where the specific BET surface area (determined by the method of G. N. Sears, Analytical Chemistry vol. 28, no. 12, 1981-1983, December 1956, as described below), which correlates with particle size, is 15 to 2000 $m^2/g$. The surface of the $SiO_2$ particles has a charge which is balanced by a corresponding counterion that leads to stabilization of the colloidal solution. The alkali-stabilized silica sols have a pH of 7 to 11.5 and contain, as alkalizing agents, for example, small amounts of $Na_2O$, $K_2O$, $Li_2O$, ammonia, organic nitrogen bases, tetraalkylammonium hydroxides or alkali metal or ammonium aluminates. Silica sols may also be in weakly acidic form as semistable colloidal solutions. It is also possible to produce cationic silica sols by coating the surface with $Al_2(OH)_5Cl$. The solids concentrations of the silica sols are preferably 5% to 60% by weight of $SiO_2$.

The production steps in the production process for silica sols are essentially: de-alkalization of waterglass by means of ion exchange, establishing and stabilizing the respectively desired particle size (distribution) of the $SiO_2$ particles, establishing the respectively desired $SiO_2$ concentration and optionally surface modifying the $SiO_2$ particles, for example with $Al_2(OH)_5Cl$. The $SiO_2$ particles do not leave the colloidally dissolved state in any of these steps. This explains the presence of the discrete primary particles having high binder effectiveness for example.

Silica gels are understood to mean colloidally formed or unformed silica of elastic to solid consistency with loose to dense pore structure. The silica is in the form of highly condensed polysilicic acid. On the surface are siloxane and/or silanol groups. The silica gels are prepared from waterglass by reacting with mineral acids. The primary particle size is generally 3 to 20 nm, and the specific surface area 250 to 1000 $m^2/g$.

The specific surface area is determined in the present invention by the method of G. N. Sears, Analytical Chemistry vol. 28, no. 12, 1981-1983, December 1956.

In addition, a distinction is made between fumed silica and precipitated silica. In the precipitation process, water is initially charged and then waterglass and acid, such as $H_2SO_4$, are added simultaneously. This gives rise to colloidal primary particles that agglomerate as the reaction progresses and fuse to form agglomerates. The specific surface area is 30 to 800 $m^2/g$, and the primary particle size 5 to 100 nm. The primary particles of these silicas in solid form are firmly crosslinked to form secondary agglomerates.

Fumed silica can be produced by flame hydrolysis or with the aid of the light arc method. The dominant synthesis method for fumed silicas is flame hydrolysis, in which tetrachlorosilane is broken down in a hydrogen-oxygen gas flame. The silica formed here is x-ray-amorphous. Fumed silicas have far fewer OH groups on their virtually pore-free surface than precipitated silica. The fumed silica produced by flame hydrolysis has a specific surface area of 50 to 600 $m^2/g$ and a primary particle size of 5 to 50 nm; the silica produced by the light arc method has a specific surface area of 25 to 300 $m^2/g$ and a primary particle size of 5 to 500 nm.

Further details of synthesis and properties of silicas in solid form can be found, for example, in K. H. Büchel, H. -H. Moretto, P. Woditsch "Industrielle Anorganische Chemie" [Industrial Inorganic Chemistry], Wiley VCH Verlag 1999, ch. 5.8.

If an $SiO_2$ raw material, for example fumed or precipitated silica, in the form of an isolated solid is used for the polymer dispersion of the invention, it is converted to an aqueous $SiO_2$ dispersion by dispersing. For production of the silicon dioxide dispersions, prior art dispersers are used, preferably those suitable for generating high shear rates, for example Ultraturrax or dissolver disks.

Preferred polymer dispersions of the invention are those in which the $SiO_2$ particles of the silicon dioxide dispersion c) are in the form of discrete uncrosslinked primary particles. It is likewise preferable that the $SiO_2$ particles have hydroxyl groups at the particle surface. More preferably, aqueous silica sols are used as aqueous silicon dioxide dispersions c).

Whether $SiO_2$ particles have hydroxyl groups at the particle surface can be ascertained, for example, by means of the test method that follows. The silica sol is acidified and then titrated with an alkali. This deprotonates the OH groups accessible at the surface of the $SiO_2$ particles, and the amount of titration alkali consumed is determined. Since silica is a weak acid, the finding of the consumption of sodium hydroxide solution between pH=4 and a final pH of about 9 is used for the OH functionality. This method was described in G. W. Sears, Jr., Anal. Chem., 28, 1981 (1956).

An essential property of the silicas of the invention is their thickening action in formulations of polychloroprene dispersions, the effect of which is that the adhesives thus produced form finely divided, sedimentation-stable dispersions, have good processibility and also have high creep resistance on nonwoven webs.

Aqueous compositions comprising a polychloroprene dispersion and/or a polyurethane dispersion a) according to the present invention and a silicon dioxide dispersion c) according to the present invention are mixtures of commercially available dispersions. Suitable polychloroprene dispersions a1) according to the present invention are commercially available under the Dispercoll® C trade name, especially Dispercoll® C 74, C 84, C 86, C 2325 and C 2372-1, from Covestro Deutschland AG. One example of a suitable polyurethane dispersion a2) is Dispercoll® U 53F (Covestro Deutschland AG). Suitable silicon dioxide dispersions c) according to the present invention are commercially available under the Dispercoll® S trade name, especially Dispercoll® S 5005 (55 nm), S 4510 (30 nm), S 4020 (15 nm), S3030/1 (9 nm), S 2020XP (15 nm), more preferably Dispercoll® S 4510, from Covestro Deutschland AG. The average particle diameter is given between parentheses above.

According to the invention, it is also possible to use a mixture of the aforementioned Dispercoll® grades, preference being given to the presence of Dispercoll® S 4510 and/or S 3030/1.

In a further particularly preferred embodiment, the aqueous composition includes 10% to 90% by weight of an aqueous silicon dioxide dispersion, preferably having an average particle diameter of the silicon dioxide particles of 1 to 400 nm (component c).

The proportion of the respective components is based on the total weight of the nonvolatile components of the aqueous composition; the sum total of the components of the aqueous composition a) to d) adds up to 100% by weight.

Additives d)

The aqueous composition of the present invention may optionally comprise additives.

For example, it is possible to add wetting agents, especially polyphosphates, such as sodium hexametaphosphate, naphthalenesulfonic acid, ammonium or sodium polyacrylates. Likewise suitable are salts of polyacrylic acids, especially sodium salts of polyacrylic acids, commercially available, for example, under the Dispex N40 trade name from BASF. Preferably are added in an amount of 0.2% to 0.6% by weight; all figures based on nonvolatile components of the aqueous composition.

In addition, it is possible to add flame retardants to the aqueous composition in order to increase the fire safety of the shaped bodies produced therefrom. Examples of flame retardants include: organic phosphorus and nitrogen compounds, organochlorine and organobromine compounds, and inorganic flame retardants, for example antimony trioxide or aluminum hydroxide. In the context of the present invention, preference is given to using aluminum hydroxide as flame retardant in the aqueous composition; particular preference is given here to using aluminum hydroxide having a median particle size d(50) in the range from 1.0 to 3.9 μm, especially 1.7-2.1 μm.

In further embodiments that are not preferred, however, it is also possible to add fungicides for preservation. These are used in amounts of 0.02% to 1% by weight, based on nonvolatile components, of the aqueous composition. Suitable fungicides are, for example, phenol and cresol derivatives or organotin compounds.

It is optionally also possible to add tackifying resins, for example unmodified or modified natural resins such as rosin esters, hydrocarbon resins or synthetic resins, such as phthalate resins, to the polymer dispersion of the invention in dispersed form (see, for example, in "Klebharze" [Tackifying Resins] R. Jordan, R. Hinterwaldner, p. 75-115, Hinterwaldner Verlag Munich 1994). Preference is given to alkylphenol resin and terpene phenolic resin dispersions having softening points greater than 70° C., more preferably greater than 110° C.

It is likewise possible to use organic solvents, for example toluene, xylene, butyl acetate, methyl ethyl ketone, ethyl acetate, dioxane or mixtures thereof, or plasticizers, for example those based on adipate, phthalate or phosphate, in amounts of 0.5 to 10 parts by weight, based on nonvolatile components of the aqueous composition.

The aqueous composition of the present invention may also contain 0.1% to 30% by weight, preferably 1.5% to 15% by weight, of at least one pigment, preferably selected from white pigments, more preferably from chalk, $TiO_2$, ZnO, MgO, $Al(OH)_3$, $Al_2O_3$ or mixtures thereof.

Zinc oxide or magnesium oxide may be used as acceptor for small amounts of hydrogen chloride that can be eliminated from the chloroprene polymers, and are therefore additionally present in preferred embodiments. These are added in amounts of 0.1% to 10% by weight, preferably of 1% to 5% by weight, based on the nonvolatile components of the aqueous composition, and may be partly hydrolyzed or contain hydrolyzable components in the presence of the polychloroprene dispersions (a1). In this way, it is possible to raise the viscosity of the polymer dispersion and adjust it to a desired level.

This hydrolysis is described for ZnO, for example, in "Gmelins Handbuch der anorganischen Chemie" [Gmelin's Handbook of Inorganic Chemistry], 8th edition, 1924, Verlag Chemie Leipzig, vol. 32, p. 134/135 and in supplementary volume 32, Verlag Chemie, 1956, p. 1001-1003. For MgO it is described, for example, in "Gmelins Handbuch der anorganischen Chemie", 8th edition, 1939, Verlag Chemie Berlin, vol. 27, p. 12/13, 47-50, 62-64.

It is alternatively possible to add other stabilizers, for example litharge, or additives that are hydrolyzed in the presence of alkaline polychloroprene dispersions.

If a higher viscosity of the aqueous composition of the invention is undesirable, additions of ZnO or MgO can be dispensed with without adversely affecting the storage stability of the product.

In preferred embodiments, the at least one additive is selected from pigments, flame retardants, antioxidants, dispersing aids, emulsifiers, wetting agents, adhesion promoters and defoamers.

Aqueous Composition

For production of the aqueous composition of the invention, the ratios of the individual components are chosen such that the resulting dispersion has a content of nonvolatile constituents of 25% to 60% by weight, preferably 30% to 50% by weight, where the proportions of the polychloroprene dispersion and/or of the polyurethane dispersion (a) are from 9.9% to 90% by weight, preferably 14.7% to 75% by weight, and the proportion of the silicon dioxide dispersion (c) is from 9.9% to 90% by weight, preferably 24.7% to 85% by weight, more preferably from 40% to 75% by weight, where the percentages are based on the weight of nonvolatile components of components a) to d) and add up to 100% by weight.

It is optionally also possible to add other dispersions, for example polyacrylate, polyvinylidene chloride, polybutadiene, polyvinylacetate or styrene-butadiene dispersions, to the polychloroprene dispersions and/or polyurethane dispersions in a proportion of up to 30% by weight.

Preparation of the Aqueous Composition

The aqueous composition of the invention is produced by simple mixing of components (a) to (d). The polychloroprene dispersion and/or the polyurethane dispersion (a) is preferably initially charged, and the other components are added while stirring. In a particularly preferred embodiment, the thickener (b) is added as the last component of the mixture.

The composite component of the present invention further comprises at least one nonwoven web.

Suitable nonwoven webs in the context of the present invention are all nonwoven webs that are known to the person skilled in the art in the field of composite components.

Usable fiber or filler materials are synthetic, regenerated and natural fibers, and mixtures thereof. In preferred embodiments, mixtures of elastic and inelastic fibers or filaments are produced.

Inelastic fibers or filaments for the first textile sheet are, for example, cotton, viscose and synthetic fibers or filaments, for example polyacrylic, polyamide, aramid, polyester, polyolefins or inorganic fiber materials, for example glass fibers or carbon fibers.

Elastic fiber or filament elements are, for example, yarns of elastodiene, thermoplastic elastomers, elastane, elastic polyamide or polyurethane fibers, textured synthetic yarns, twisted cellulose crepe filaments or spun cellulose crepe filaments.

The nonwoven webs preferably consist of polyolefin-, polyethylene terephthalate-, polyether sulfone-, glass-, mineral- or plant-based fibers, such as cotton fibers, coconut fibers, rice cotton fibers, or mixtures thereof, and/or have a density of 300 to 1200 g/m$^2$, preferably 400 to 550 g/m$^2$ or 900 to 1100 g/m$^2$.

Both the elastic and inelastic fibers or filaments, depending on the thickness of the desired nonwoven web, may be used in different thickness. The fiber thickness of the inelastic fibers is preferably 0.01-1 tex (tex=unit of measurement of filament fineness in g/1000 m). The filament fineness of the elastic filaments is preferably 4-80 tex, preferably 10-40 tex, more preferably 15-30 tex.

The nonwoven webs may consist of one or more different types of filaments or fibers that differ from one another in terms of the material and/or yarn thickness. It is possible for one or more types of inelastic yarns and, if present, one or more types of elastic yarns to be included.

The longitudinal extensibility of the nonwoven webs is preferably 30-200%, further preferably 60-110%, especially preferably 85-100%. The transverse extensibility of the nonwoven webs is preferably 10-120%, further preferably 30-100%, especially preferably 40-90%.

The nonwoven webs may be dyed or undyed. In addition, the nonwoven webs may have been needled, carded or thermally preset.

The nonwoven webs may additionally also comprise or consist of flame-retardant fibers, in order to improve the flame retardancy of the composite component. A suitable commercially available flame retardant for fibers is Aflammit® from Thor or Exolit® from Clariant. It is likewise possible to use red phosphorus.

In the process, the semifinished product obtained after the coagulation is shaped by pressing and/or heating to give the composite component. The steps can be conducted here by the methods customary to the person skilled in the art in the field of composite components, for example in a press. If heating is to be used, the semifinished product may be heated before being introduced into the press. Alternatively, it is possible that the semifinished product is simultaneously heated and pressed in the press.

If the pressing step takes place, this preferably lasts for 0.1 to 30 seconds, more preferably for 1 to 15 seconds, especially preferably for 3 to 10 seconds.

The composite component obtained can then be processed further. This can be done, for example, by applying a layer, preferably of a thermoplastic polymer or resin, to a portion or the whole surface of the composite component and then optionally applying a decoration. Suitable decorations here are all of those known to the person skilled in the art, for example textile fabrics, preferably with foam backing, leather or films. This can further support and consolidate the composite component. The thermoplastic polymer may be selected here from customary thermoplastic polymers, such as polyolefins or polyurethanes. It is likewise possible that the thermoplastic polymer is the binder as described above. If resins are used, it is likewise possible to use those described above.

The semifinished product can be processed in various apparatuses or in a "one-shot" process within a press. This one-shot process preferably comprises the following steps:

A. The nonwoven web is wetted with binder and heated up. This gives a dry, warm and binder-coated nonwoven web.

B. The decoration, for example a textile fabric with foam backing, is likewise wetted with binder on the foam side, but is not dried or not dried completely, so as to leave a moist adhesive film.

C. The binder-coated decoration is placed by the moist adhesive film side onto the binder-coated nonwoven web from step A. or is run into the press by respective rolls and then pressed.

In the course of this, the joining of the parts is accomplished firstly by thermoplastic fiber forming, and later by the coherence and curing of the binder and the slower curing of the adhesive film. On their own, neither the cooling of the thermoplastic nor the curing of the binder would be possible in such a rapid manner. High pressure alone also usually does not lead to satisfactory solutions for the decoration. The combination of the two measures, by contrast, brings success, and the later crystallizing brings strength. The binder for the adhesive join of the lamination/textile should preferably not have been filled to excessive hardness or have been made too hard. In that case, the load-bearing element would be quite firm, but the adhesive bond of textile and load-bearing element may possibly have inadequate stability.

Alternatively, or after the application of the above-described layer, optionally with decoration applied, it is likewise possible to perform further forming of the composite component by another pressing operation and/or another heat treatment. Automatic edge-folding of the composite component or of the further-processed composite component is also possible, so as to result in a durable composite in the edge-fold region. This requires adaptation of the circumferential trim to the edge-fold, for an intended breakage site to weaken the material in the radius B side, and for there to be an adequate energy source (pressure, temperature, high-frequency energy).

Alternatively, the composite component or the further-processed composite component can be cut to size or punched as described above, in order to obtain a desired shape.

The composite component obtained in accordance with the invention finds use as a constituent of an interior trim part, a sunvisor, a load-bearing part, a 2- or 3-dimensional soundproofing panel, a 3-dimensional printed component, a cushioning material, a collision protection barrier, a seat bucket and an impact insulation.

EXAMPLES

Figure 2:
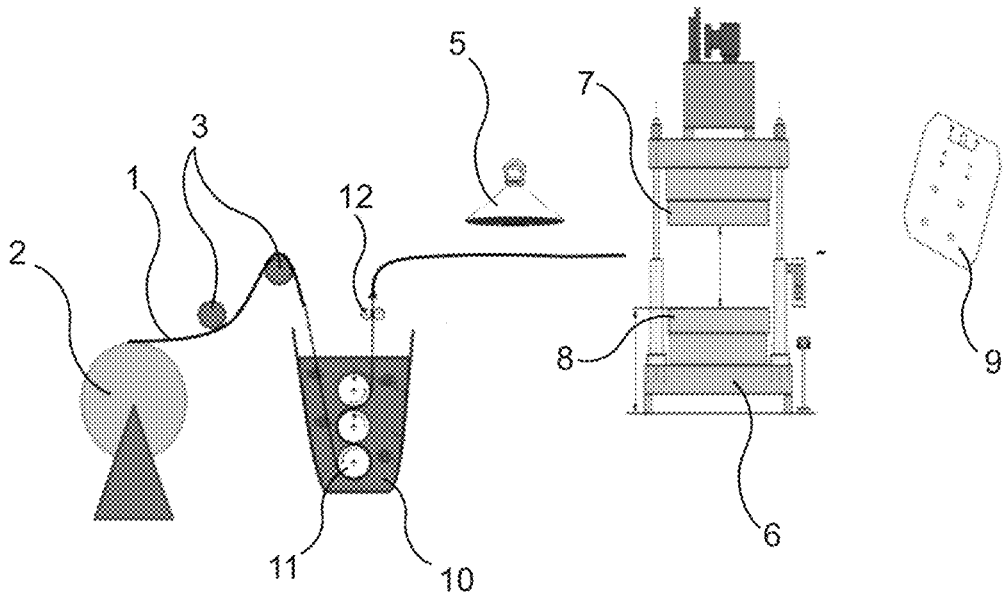
Figure 3:
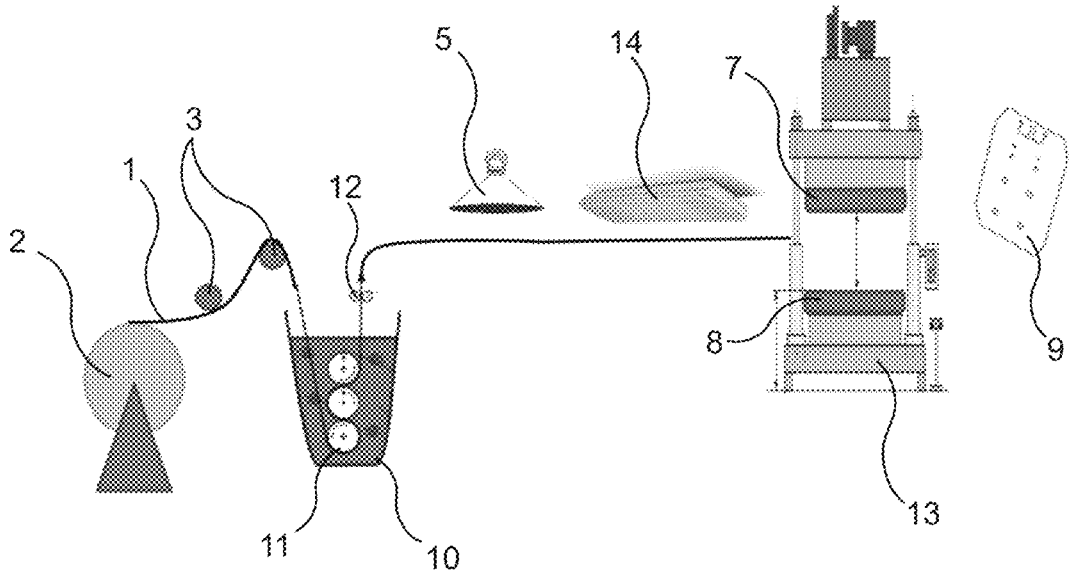

The present invention is elucidated in detail hereinafter with reference to working examples and FIGS. 1 to 3. These figures show:

FIG. 1 a first production process for a composite component of the invention, FIG. 2 a second production process for a composite component of the invention and FIG. 3 a third process for production of a composite component of the invention.

FIG. 1 shows a first continuous production process for creation of a composite component 9 of the invention. In this process, a nonwoven web 1 is fed from a roll 2 via two guide rolls 3 to a binder application device 4, a spraying device in the present context. The binder application device 4 applies the binder to both sides of the nonwoven web 1. The nonwoven web 1 thus coated is then fed to a reactant application device 5, where a coagulant is applied by spraying. Subsequently, the nonwoven web 1 is fed to a press 6 with hydraulically actuated and heated press tables 7. The coated nonwoven web 1 is pressed therein into the desired shape, heated and simultaneously cut to the desired size with a stamping device likewise disposed in the press 6. The cutting or punching of the composite component 9 is especially performed in a pinch edge mold. On attainment of the residence time, the composite component 9 of the invention is then ejected and the process is repeated.

FIG. 2 shows an alternative continuous production process for creation of a composite component 9 according to the invention. This differs from the process shown in FIG. 1 essentially in that the binder application device is implemented in the form of a dip bath 10, through which the nonwoven web 1 is guided by means of a squeeze roll arrangement 11, in the course of which it is contacted with the binder. In the squeeze roll arrangement 11, the weight of the rolls generates pressure on the nonwoven web 1 conducted between the rolls and hence controls the amount of binder applied. When it leaves the dip bath 10, the coated nonwoven web 1 is guided through a gap between two stripping rolls 12, by means of which excess binder is removed and fed back to the dip bath 10. The rest of the process steps proceed in the manner described in FIG. 1.

FIG. 3 shows a third variant of a continuous production process of the invention. This is based essentially on the procedure shown in FIG. 2, except that, in the embodiment shown in FIG. 3, the press 13 does not include a heated press table, but an unheated mold. The coated nonwoven web material is heated on one side or both sides directly upstream of the press 13 by a heating station 14, by means of a hotplate or infrared radiative heating. Typical heating temperatures here are about 220° C. Since this upstream heating station 14 already starts the curing reaction of the binder, it is possible here to dispense with any additional heating of the press mold or stamping tool in the pressing and stamping operation. The nonwoven web has a temperature of 30° C. to 220° C. on entry into the press 13, according to the transport speed and distance between the heating station 14 and the press 13.

Production of the Aqueous Binder Dispersion

Example of a Mixture Based on Polychloroprene

Into an initial charge of 2690.8 g of Dispercoll® C 2325 (polychloroprene dispersion, solids content 55%, Covestro Deutschland AG) are metered successively, while stirring, 64.69 g Rhenofit® DDA-50 EM (aging stabilizer, solids content 50%, Lanxess AG), 64.69 g of Emulvin® W (emulsifier, solids content 65%, Lanxess AG), 6278.54 g of Dispercoll® S 4510 (silica sol dispersion, solids content 45%, Covestro Deutschland AG), 520.63 g of Martinal® OI-104 (flame retardant based on aluminum hydroxide, Martinswerk GmbH) and 523.04 g of Borchigel® A LA (thickener, solids content 10%, 1:1 diluted with water to solids content 5%, OMG Borchers GmbH), and the mixture is stirred for a further 30 min. Subsequently, the dispersion is left to stand at RT for 24 hours. The resultant aqueous binder dispersion has a solids content of 50%, a pH of 9.9 and a viscosity of 1240 mPas.

Example of a Mixture Based on Polyurethane

Into an initial charge of 3218.1 g of Dispercoll® U 53F (polyurethane dispersion, solids content 40%, Covestro Deutschland AG) are metered successively, while stirring, 33.9 g of Rhenofit® DDA-50 EM (aging stabilizer, solids content 50%, Lanxess AG), 33.8 g of Emulvin® W (emulsifier, solids content 65%, Lanxess AG), 2335.8 g of Dispercoll® S 3030-1 (silica sol dispersion, solids content 30%, Covestro Deutschland AG), 271.51 g of Martinal® OI-104 (flame retardant based on aluminum hydroxide, Martinswerk GmbH) and 382.5 g of Borchigel® A LA (thickener, solids content 10%, 1:1 diluted with water to solids content 5%, OMG Borchers GmbH), and the mixture is stirred for a further 30 min. Subsequently, the dispersion is left to stand at RT for 24 hours. The resultant aqueous binder dispersion has a solids content of 37%, a pH of 10.2 and a viscosity of 1750 mPas.

Examples 1 and 2: Production of the Composite Components (Trim Parts)

For the production of the composite components, configured as trim parts in the present case, a 1000 g/m$^2$ PES nonwoven web composed of 60% by weight of black PES and 40% by weight of white PES bi-component fiber is used, giving rise to a gray nonwoven web. Such a nonwoven web was wetted in each case with one of the above-described compositions at 300 g/m$^2$ dry weight and blown into the nonwoven web with the aid of compressed air. Subsequently, the material was heated at 200 to 220° C. for about 30 to 90 sec and then pressed in a mold at room temperature, giving the trim parts.

The invention claimed is:

1. A composite component obtained by a process comprising the steps of:

i) applying an aqueous composition comprising a polychloroprene dispersion and/or a polyurethane dispersion to at least one nonwoven web;

ii) coagulating the aqueous composition on the nonwoven web by contacting with a coagulant and/or heating to 80 to 220° C. in order to form a semifinished product comprising a binder formed from the aqueous composition;

iii) optionally applying a decoration including an adhesive film;

iv) then shaping the semifinished product from step ii) or iii) by pressing and/or heating to 30 to 220° C., in order to obtain the composite component; and v) optionally applying a layer to a portion or the whole surface of the composite component and then optionally applying a decoration, wherein the aqueous composition comprises at least one thickener, wherein the aqueous composition further comprises an aqueous silicon dioxide dispersion in the amount of 9.9 to 90% by weight, based on the total weight of the nonvolatile components of the aqueous composition.

2. An article comprising the composite component as claimed in claim 1.

3. A method comprising utilizing the composite component as claimed in claim 1 as a constituent of an interior trim part, a sunvisor, a load-bearing part, a 2- or 3-dimensional soundproofing panel, a 3-dimensional printed component, a cushioning material, a collision protection barrier, a seat bucket or an impact insulation.

4. The composite component of claim 1, wherein the polychloroprene dispersion and/or the polyurethane dispersion has an average particle size of 60 to 300 nm.

5. The composite composition of claim 1, wherein the aqueous composition further comprises additives.

6. The composite component of claim 1, wherein the aqueous composition comprises:

9.9% to 90% by weight of the polychloroprene dispersion and/or the polyurethane dispersion;

0.01% to 15% by weight of the at least one thickener;

9.9% to 90% by weight of the aqueous silicon dioxide dispersion; and

0% to 50% by weight of additives; based in each case on the total weight of the nonvolatile components of the aqueous composition.

7. The composite component of claim 1, wherein the aqueous composition has a viscosity of 500 to 7000 mPa*s, determined according to DIN ISO 2555 by means of a Brookfield rotary viscometer with spindle #2 up to a viscosity of 2500 mPa*s, and above that with a spindle #3, at 12 rpm and 23° C.

8. The composite component of claim 1, wherein, after step ii), 20 to 600 g/m2 dry weight of binder is present on a nonwoven web.

9. The composite component of claim 1, wherein the at least one nonwoven web consists of polyolefin-, polyethylene terephthalate-, polyether sulfone-, glass-, mineral-, carbon-, or plant-based fibers, such as cotton fibers, coconut fibers, rice cotton fibers, or mixtures thereof; and/or in that a nonwoven web has a density of 300 to 1200 g/m2.

10. The composite component of claim 1, wherein at least two nonwoven webs are used, and the binder is between the nonwoven webs.

11. The composite component of claim 1, wherein a coagulant is used.

12. The composite component of claim 1, wherein the decoration, a textile fabric with foam backing, is wetted with binder on the foam side in step iii), but is not dried or not dried completely, so as to leave a moist adhesive film, and the binder-coated decoration is placed by the moist adhesive film side onto the binder-coated nonwoven web from step ii) or is run into a press by respective rolls and then pressed in step iv).

13. The composite component of claim 1, wherein the composite component is a constituent of an interior trim part, a sunvisor, a load-bearing part, a 2- or 3-dimensional soundproofing panel, a 3-dimensional printed component, a cushioning material, a collision protection barrier, a seat bucket or an impact insulation.

* * * * *